US006786248B2

(12) United States Patent
Johnson et al.

(10) Patent No.: US 6,786,248 B2
(45) Date of Patent: Sep. 7, 2004

(54) FILL VALVE ASSEMBLY FOR FILLER DEVICE

(75) Inventors: Randall L. Johnson, Grand Haven, MI (US); Simon P. Edwards, Irvine, CA (US); Michael R. Resterhouse, Muskegon, MI (US); Robert B. Szabo, II, Allegan, MI (US)

(73) Assignees: Fogg Filler Company, Holland, MI (US); Scholle Corporation, Irvine, CA (US)

( * ) Notice: Subject to any disclaimer, the term of this patent is extended or adjusted under 35 U.S.C. 154(b) by 151 days.

(21) Appl. No.: 10/268,547

(22) Filed: Oct. 10, 2002

(65) Prior Publication Data

US 2003/0071237 A1 Apr. 17, 2003

Related U.S. Application Data

(60) Provisional application No. 60/328,475, filed on Oct. 11, 2001.

(51) Int. Cl.[7] ..... B65B 1/04; B65B 43/42

(52) U.S. Cl. ..... 141/90; 141/146; 251/63.5

(58) Field of Search ..... 141/90, 91, 177, 141/181, 182, 129, 146; 222/409, 559; 251/63.5, 63.6, 62

(56) References Cited

U.S. PATENT DOCUMENTS

| | | | | |
|---|---|---|---|---|
| 2,478,790 A | | 8/1949 | Stephens | |
| 2,722,402 A | | 11/1955 | Crookston | |
| 3,430,639 A | | 3/1969 | Roberts | |
| 3,568,734 A | | 3/1971 | Vadas et al. | |
| 3,774,658 A | | 11/1973 | Abramoska, Jr. | |
| 3,871,425 A | * | 3/1975 | Fee et al. | 141/5 |
| 3,926,229 A | | 12/1975 | Scholle | |
| 4,136,851 A | | 1/1979 | Hansen et al. | |
| 4,141,394 A | * | 2/1979 | Lassman et al. | 141/284 |
| 4,219,054 A | | 8/1980 | Carter et al. | |
| 4,344,469 A | * | 8/1982 | Brown | 141/90 |
| 4,437,498 A | | 3/1984 | Pankratz et al. | |
| 4,615,354 A | | 10/1986 | Bianchi | |
| 4,784,193 A | * | 11/1988 | Schmied et al. | 141/198 |
| 4,848,381 A | | 7/1989 | Livingston et al. | |
| 5,178,304 A | * | 1/1993 | Torterotot | 222/409 |
| 5,402,833 A | | 4/1995 | Clusserath | |
| 5,450,882 A | | 9/1995 | Cragun | |
| 5,531,253 A | | 7/1996 | Nishiyama et al. | |
| 5,533,552 A | | 7/1996 | Ahlers | |
| 5,690,151 A | | 11/1997 | Rutter et al. | |
| 5,740,844 A | | 4/1998 | Miller | |
| 5,769,136 A | * | 6/1998 | Kanematsu et al. | 141/129 |
| 5,845,683 A | | 12/1998 | Sundby et al. | |
| 5,878,992 A | | 3/1999 | Edwards et al. | |
| 2003/0052293 A1 | * | 3/2003 | Enzaki et al. | 251/63.6 |
| 2004/0020552 A1 | * | 2/2004 | Ruffer et al. | 141/7 |

FOREIGN PATENT DOCUMENTS

| | | |
|---|---|---|
| EP | 0 554 951 A1 | 2/1993 |
| EP | 0 568 121 A1 | 2/1993 |
| JP | 53136177 A | 5/1977 |
| JP | 57083762 A | 11/1980 |

* cited by examiner

*Primary Examiner*—Gregory L. Huson
*Assistant Examiner*—Khoa D. Huynh
(74) *Attorney, Agent, or Firm*—King & Jovanovic, PLC

(57) ABSTRACT

A fill valve assembly for use in association with a filler device comprising an outer housing, a product dispensing member, a displaceable piston and a seal member. The product dispensing member is associated with the outer housing. The displaceable piston is displaceably positioned within the outer housing. The seal member is fixedly associated with the displaceable piston at one end thereof, and at least one of the outer housing and the product dispensing member, at another end thereof. The seal member is capable of maintaining fixed association throughout displacement of the displaceable piston, such that isolation of outer housing and the product dispensing member can be maintained without the use of seals having slidable engagement.

7 Claims, 1 Drawing Sheet

FILL VALVE ASSEMBLY FOR FILLER DEVICE

CROSS-REFERENCE TO RELATED APPLICATION

This application claims the priority of co-pending Provisional Patent Application Serial No. 60/328,475 filed Oct. 11, 2001, entitled "Fill Valve Assembly for Filler Device."

BACKGROUND OF THE INVENTION

1. Field of the Invention

The present invention relates in general to a fill valve assembly, and more particularly, to a fill valve assembly for use in association with a filler device, which maintains a fill material (e.g. fluid) in desired regions, and substantially precludes undesirable contamination of the fill valve assembly by the fill material.

2. Background Art

Fill valve assemblies for use in association with filler devices have been known in the art for many years. While fill valve assemblies have become commercially available for use in association with filler devices the cleanliness of associated components remains problematic. Cleanliness of the components is especially problematic with respect to fill valve assemblies which are used in association with, for example, food products (hereinafter referred to as the fill material), where cleanliness and sanitation standards are relatively stringent.

For example, fill valve assemblies have a plurality of movable and/or displaceable components which can be, at some point during the fill process, in direct contact with the fill material. As these parts move relative to each other, the fill material can be spread to other regions of the fill valve assembly. While seals can be positioned, in an attempt to preclude and/or minimize any undesirable spread of the fill material (or, conversely, the passage of contaminants into the fill material) it is extremely difficult to maintain the desired sanitized conditions over an extended period—due to rapid movement and sliding seal interfaces. As such, it becomes necessary to disassemble or to otherwise interrupt operation to clean the fill valve assembly.

Accordingly, it is an object of the present invention to provide a fill valve assembly which precludes the undesirable spreading of fill material or contamination thereof.

It is another object of the present invention to provide a fill valve assembly which is capable of operating for many cycles and/or extended periods of time without undesirable spreading of fill material or contamination thereof.

SUMMARY OF THE INVENTION

The invention comprises a fill valve assembly for use in association with a filler device. The fill valve assembly comprises an outer housing, a product dispensing member, a displaceable piston and a seal member. The product dispensing member is associated with the outer housing. The displaceable piston is positioned within at least a portion of the outer housing and the product dispensing member. The seal member is fixedly associated with the displaceable piston at one end thereof and fixedly associated with at least one of the outer housing and the product dispensing member at another end thereof.

In one preferred embodiment, the seal member comprises a bellows having a plurality of flexing regions. In one such embodiment, the flexing regions of the bellows define a plurality of peaks and valleys. The valleys are positionable proximate the piston, and the peaks extend outwardly therefrom.

In a preferred embodiment, the seal member includes a region of increased rigidity proximate at least one of the first and second ends thereof. Preferably, the seal member includes a region of increased rigidity proximate each of the first and second ends thereof.

In one embodiment of the invention, the displaceable piston further comprises a body and a sleeve. The body includes a first end, a second end, and a lip positioned therebetween. The sleeve includes a first end and a second end. The sleeve extends over at least a portion of the body between the first end and the lip. The second end of the sleeve is positioned proximate the lip of the body.

In one such embodiment, the second end of the seal member is fixedly engaged between the second end of the sleeve and the lip of the body.

In another such embodiment, the piston further comprises a spacer positioned proximate each of the first ends of the body and the sleeve. The spacer is slidably positionable relative to the body and fixedly engageable with the first end of the sleeve. Downward movement of the spacer imparts downward movement of the second end of the sleeve toward the lip of the body.

In a preferred embodiment, the product dispensing member further comprises an upper assembly and a lower assembly.

In another preferred embodiment, the invention further comprises a displacing member comprising an annular ring and means for displacing the annular ring. The annular ring is associated with the displaceable piston such that movement of the annular ring imparts movement upon the displaceable piston. The annular ring is positioned with an inner cavity of the outer housing so as to bisect the inner cavity into an upper inner cavity and a lower inner cavity. The annular ring displacing means displaces the annular ring within the inner cavity.

In a preferred embodiment, the displacing means further comprises an upper fluid port and a lower fluid port. The upper fluid port is in communication with the upper cavity. The lower fluid port is in communication with the lower cavity. Fluid can be selectively directed to each of the upper and lower fluid ports so as to displace the annular ring with the inner cavity.

BRIEF DESCRIPTION OF THE DRAWINGS

The invention will now be described with reference to the drawings wherein.

DETAILED DESCRIPTION OF THE INVENTION

Figure 1:
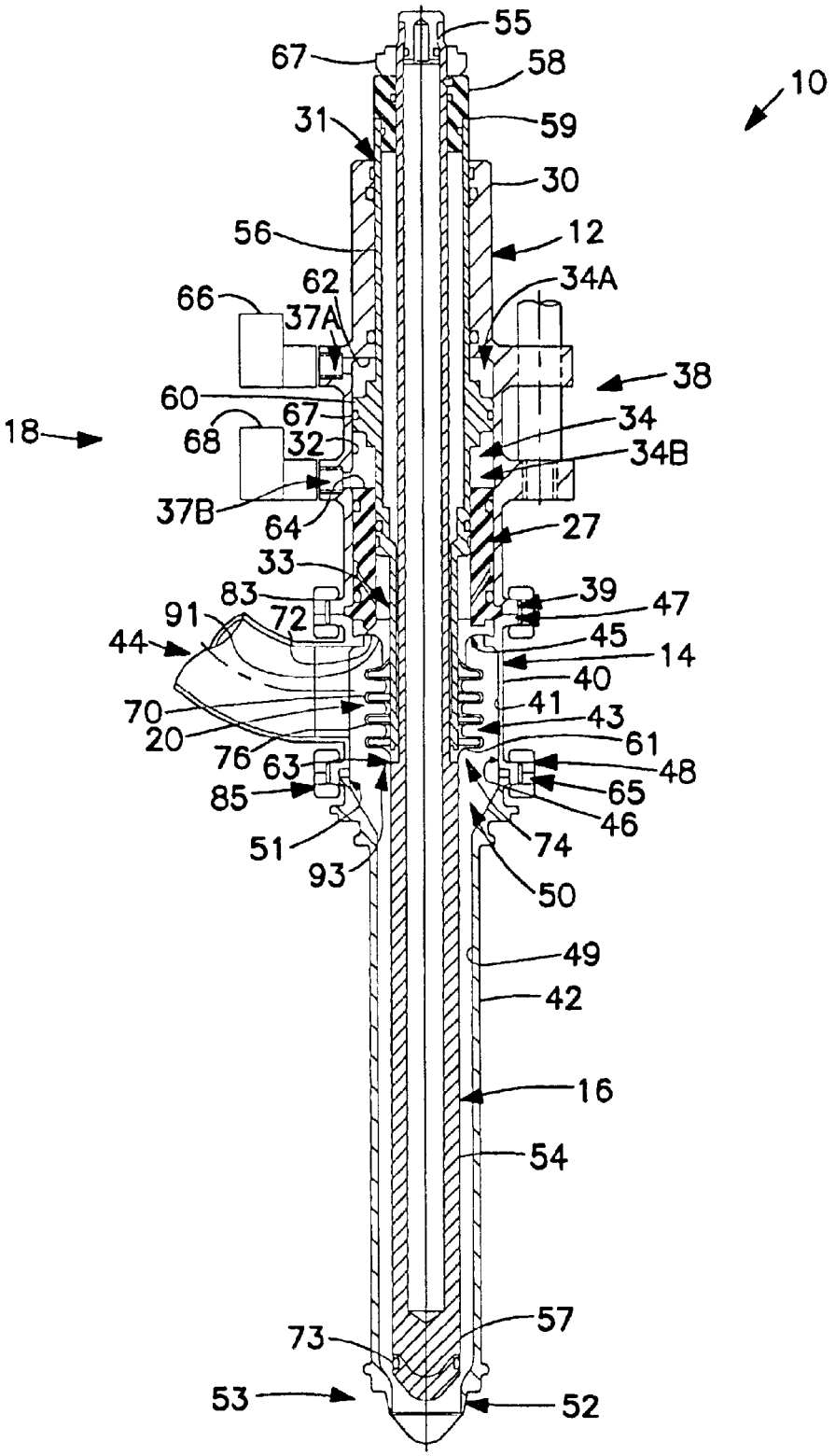
FIG. 1 of the drawings is a cross-sectional view of an embodiment of a fill valve assembly fabricated in accordance with the present invention.

While this invention is susceptible of embodiment in many different forms, there is shown in the drawings and will be described in detail, a specific embodiment with the understanding that the present disclosure is to be considered as an exemplification of the principles of the invention and is not intended to limit the invention to the embodiment illustrated.

It will be understood that like or analogous elements and/or components, referred to herein, are identified throughout the drawing by like reference characters. In addition, it will be understood that the drawing is merely a schematic representation of a first embodiment of the invention, and some of the components may have been distorted from their actual scale for purposes of pictorial clarity.

Referring now to the drawings, and to FIG. 1 in particular, a cross-sectional view of a first embodiment of fill valve assembly 10 is provided as generally comprising outer housing 12, product dispensing member 14, piston 16, displacing member 18 and seal member 20. Fill valve assembly 10 is primarily intended for use in association with filler devices, which are generally capable of filling associated containers and/or bags with any one of a number of fill materials in solid, liquid, and/or gaseous states. Such filler devices may comprise linear filler devices, rotary filler devices and other devices which are capable of filling containers with fill material.

Outer housing 12 is shown in FIG. 1 as including outer surface 30, upper opening 31, inner surface 32, lower opening 33, inner cavity 34, passages 37A, 37B, mounting assembly 38 and attachment lip 39. Upper opening 31 and lower opening 33 are substantially collinear and facilitate the passage of piston 16 therethrough. Mounting assembly 38 is associated with outer surface 30 and facilitates the attachment of the housing, and in turn, the fill valve to the filler device. In certain embodiments, guide 27 may be positioned proximate lower opening 33 so as to facilitate proper alignment and positioning of piston 16 within outer housing 12.

Passages 37A and 38B extend from outer surface 30 to inner surface 32 and fluidly communicate with inner cavity 34. As will be explained, the passages are associated with displacing member 18 to effectuate movement of piston 16. Generally, outer housing 12 comprises a rigid material which is capable of withstanding repeated loads. In one embodiment, the outer housing is fabricated from stainless steel.

Product dispensing member 14 is shown in FIG. 1 as including upper assembly 40 and lower assembly 42. Upper assembly 40 includes inner surface 41, cavity 43, inlet 44, upper opening 45, lower opening 46, upper mounting lip 47 and lower mounting lip 48. Inner surface 41 defines cavity 43. Inlet 44 is positioned so as to be in fluid communication with cavity 43 at the one end, and, in fluid communication with a product supply line at the other end. Upper opening 45 and lower opening 46 are positioned in a spaced-apart orientation and substantially collinear with the upper and lower openings of outer housing 12, for receipt and passage of piston 16 therethrough. Upper mounting lip 47 extends around upper opening 45. The upper mounting lip can be positioned in an abutting relationship with attachment lip 39 and secured thereto with compression clamps, such as compression clamp 83. Lower mounting lip 48 extends around lower opening 46, and, as will be explained, is secured to lower assembly 42.

Lower assembly 42 is shown in FIG. 1 as comprising inner surface 49, cavity 50, upper opening 51, upper mounting lip 65, nozzle 52 and outer configuration 53. Inner surface 49 defines cavity 50. In the embodiment shown in FIG. 1, inner surface 49 is configured so as to taper toward the nozzle (i.e., upper opening 51 has a larger diameter than nozzle 52). Of course, in other embodiments, different configurations for the inner surface are contemplated for use.

Upper opening 51 substantially corresponds to lower opening 46 of upper assembly 40. Upper mounting lip 65 extends about upper opening 51 and is secured to lower mounting lip 48 by way of compression clamps, such as compression clamp 85. Nozzle 52 is positioned at an end opposing upper opening 51. The opening is dimensioned to correspond to a desired fluid opening. Such an opening can be varied to achieve different fill properties and different fill characteristics. Outer configuration 53 surrounds nozzle 52, and is adapted for interfacing with the container to be filled by the valve. As such, outer configuration 53 may comprise a number of different configurations, depending on the configuration of the container to be filled by the valve.

Displaceable piston 16 is shown in FIG. 1 as comprising body 54 and sleeve 56, spacer 58 and fastener 67. Body 54 includes first end 55, second end 57, lip 63 and seal 73. Body 54 comprises a first diameter between first end 55 and lip 63, and a second larger diameter between lip 63 and second end 57. Seal 73 is positioned proximate second end 57 of body 54. In certain embodiments, seal 73 may comprise a flexible sealing member, such as, for example, a flexible o-ring made from a suitable synthetic or natural member. In other embodiments, seal 73 may comprise a machined portion of body 54 which sealingly engages nozzle 52 of lower assembly 42.

Sleeve 56 is shown in FIG. 1 as comprising first end 59 and second end 61. First end 59 substantially corresponds to first end 55 of body 54. Second end 61 substantially corresponds to lip 63 of body 54. In the embodiment shown, sleeve 56 is substantially collinear with body 54 and extends around a portion of same. Spacer 58 is positioned such that body 54 extends therethrough and spacer 56 terminates therein. In turn, spacer 58 is slidably positionable relative to body 54 and fixedly engaged with sleeve 56 at least in one direction. Fastener 67 is associated with body 54 and spacer 58. The fastener serves to force the spacer and the sleeve toward the second end of body 54, such that second end 61 of sleeve 56 is directed toward lip 63 of body 54. Piston 16 is preferably fabricated from a metal material of substantial rigidity and strength. For example, stainless steel is one such material which additionally provides a strong resistance to corrosion.

As shown in FIG. 1, displacing member 18 includes annular ring 60, upper stop 62, lower stop 64, upper fluid port 66, and lower fluid port 68. Upper stop 62 and lower stop 64 are spaced apart within inner cavity 34 so as to define the upper and lower end of inner cavity 34. Annular ring 60 is rigidly fixed to sleeve 56 of piston 16 and sized so as to interface with inner surface 32 to bisect inner cavity 34 into an upper cavity portion 34A and lower cavity portion 34B. Annular ring 60 includes seal member 67 which substantially sealingly isolates upper and lower cavity portions 34A and 34B, respectively, from each other.

Upper fluid port 66 extends through passage 37A and is in fluid communication with upper cavity portion 34A. Lower fluid port 68 extends through passage 37B and is in fluid communication with lower cavity portion 34B. The upper and lower fluid ports provide a means for displacing annular rim 60 within inner cavity 34. It is contemplated that the annular rim displacing means may comprise a single fluid port in cooperation with a biasing means, such as a spring and the like, wherein fluid is used to overcome the biasing means and to move the annular rim in a first direction, and the biasing means is used to return the annular ring after the supply from the fluid port is ceased. Additional o-rings and seals are included along inner surface 32 so as to isolate the upper and lower cavity portions 34A, 34B from upper opening 31 and lower opening 33 of outer housing 12.

In another embodiment of the invention, it is contemplated that the displacing member 18 may comprise an electrically or electronically controlled stepper or servo motor instead of the pneumatic control system shown in FIG. 1. In such an embodiment, a stepper or servo motor or other device is controlled electrically or electronically to precisely control the movement of the displaceable piston relative to the dispensing member. In addition, other displacing members are likewise contemplated for use.

Seal member 20 includes flexible seal member 70 having first end 72 and second end 74. First end 72 interfaces with outer housing 12 and product dispensing member 14 such that sealing engagement is maintained therebetween. In the embodiment shown, clamp 83 serves to compress first end 72 between lower opening 33 of outer housing 12 (and guide 27) and upper opening 45 of upper assembly 40. Second end 74 is compressed by fastener 67 between second end 61 of sleeve 56 of piston 16 and lip 63 of body 54 of piston 16. As such, sleeve 56 and outer housing 12 are fluidly isolated from cavity 43 and cavity 50 of product dispensing member 14, and conversely, the cavities 43, 50 are fluidly isolated from sleeve 56 and housing 12.

In one embodiment flexible seal member 70 may comprise a bellows which includes a plurality of predetermined flexing regions, such as flexing region 76. Of course, the number of flexing regions may comprise as little as a single flexing region to a multitude of different flexing regions. The flexing regions facilitate the controlled deformation of the seal member as the piston moves relative to product dispensing member 14. Indeed, through flexing regions 76 the movement and flexing of seal member 20 can be controlled and managed throughout the travel of piston 16. In the particular embodiment, the flexing regions define a plurality of peaks and valleys, wherein the valleys are naturally positioned proximate the sleeve and the peaks extend outwardly therefrom. By maintaining the valleys proximate the sleeve, the obstruction of cavity 43 by seal member 20 can be minimized.

In the embodiment shown, regions 91, 93 of increased rigidity may be positioned proximate first end 72 and second end 74. Such a configuration precludes distortion of a portion of seal 20 into outer housing 12 proximate lower opening 33 thereof. Similarly, such a configuration precludes inadvertent distortion of portions of the seal into cavity 50 of lower assembly 42. Furthermore, the structures can be configured.

In another embodiment, the seal member may include a highly flexible member such that there are no predetermined flexing regions, rather, the structure is capable of flexing at differing locations along the surface thereof depending on the conditions present within the cavity of the upper assembly of the dispensing member.

In the various embodiments, the seal member generally comprises a natural and/or synthetic polymer or flexibly resilient material capable of repetitive extension and/or contraction over a number of cycles—so as to properly function under conditions of its intended use. One such material may include PTFE, or the like.

In operation, fill valve assembly 10 is associated with a filler device. In particular, mounting assembly 38 of outer housing 12 is attached to a corresponding structure on the filler device, by way of, for example, fasteners and the like. Next, a material supply line is placed in fluid communication with inlet 44 of product dispensing member 14. Likewise, each of one upper fluid port 66 and lower fluid port 68 is associated with fluid supplies and associated controllers which can control the fluid delivery through the ports. In the presently contemplated embodiment, the fluid utilized with upper and lower fluid ports comprises air, however, other fluids are likewise contemplated for use.

Once the fill valve assembly is fully integrated into the filler device, a container is associated with nozzle 52. In particular, the container is directed such that the opening of the container cooperates with outer configuration 53 of the lower assembly of the dispensing member. Subsequently, fluid is directed through lower fluid port 68 into lower cavity portion 34B. The passage of fluid into the lower cavity portion forces annular ring 60 in an upward direction toward and into contact with upper stop 62. As annular ring 60 is fixedly associated with sleeve 56 of piston 16, upward movement of annular ring 60 likewise imparts upward movement of piston 16.

At such time, seal member 20 contracts as piston 16 moves relative to outer housing 12 and product dispensing member 14. As the embodiment shown includes predetermined flexing regions 76, seal member 20 uniformly folds during the contraction in a controlled manner, maintaining isolation of inner surface 32 and sleeve 56 of piston 16 from cavities 43, 50 of dispensing member 14, and, conversely, the isolation of cavities 43, 50 from inner surface 32 and sleeve 56.

As piston 16 continues in an upward direction, seal 73 is eventually displaced from nozzle 52 and fill material is permitted to flow through nozzle 52 into the container. Once the container has been filled as desired, the supply of fluid through the lower fluid port 68 into lower cavity portion 34B is halted. Instead, fluid is directed through upper fluid port 66 into upper cavity portion 34A. In turn, annular ring 60 and piston 16 are directed in a downward direction until ring 60 interferes with lower stop 64 and/or seal 73 again interfaces with nozzle 52. Once seal 73 and nozzle 52 interface, the flow of fill material through nozzle 52 ceases.

Contemporaneously, seal member 20 extends to a substantially extended position while retaining the fixed relationship with outer housing 12 and product dispensing member 14, to maintain isolation of the outer housing and the sleeve from the cavities of the product dispensing member, and, conversely, between the cavities and the outer housing and the sleeve. This cycle is repeated for each subsequent filling of containers.

Advantageously, as annular ring 60 moves from upper stop 62 to lower stop 64 and back to upper stop 62, seal member 20 repeatedly extends and contracts to maintain an effective fluid tight seal. Significantly, seal member 20 is adapted for use in place of sliding (o-ring) type seals between piston 16 and outer housing 12. In turn, the possible contamination that can result from the passage of undesirable material beyond a sliding type seal (in either direction) is eliminated as seal member 20 is fixed at either end and can contain the fill material to the product dispensing member. Moreover, the need to clean the inside surfaces of the outer housing and the cavities of the dispensing member are greatly reduced.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A fill valve assembly for use in association with a filler device, comprising:

an outer housing;

a product dispensing member associated with the outer housing;

a displaceable piston positioned within at least a portion of the outer housing and the product dispensing member, the displaceable piston further comprises:

a body having a first end, a second end, and a lip positioned therebetween;

a sleeve having a first end and a second end, the sleeve extending over at least a portion of the body between the first end and the lip, wherein the second end of the sleeve is positioned proximate the lip of the body; and a spacer positioned proximate each of the first ends of the body and the sleeve, wherein the spacer is slidably positionable relative to the body and fixedly engageable with the first end of the sleeve, whereupon downward movement of the spacer moves the second end of the sleeve toward the lip of the body; and a seal member, the seal member fixedly associated with the displaceable piston at a list end thereof, and fixedly associated with at least one of the outer housing and the product dispensing member at a second end thereof, the seal member comprises a bellows having a plurality of flexing regions, wherein the first end of the seal member is fixedly engaged between the second end of the sleeve and the lip of the body.

2. The fill valve assembly of claim 1 wherein flexing regions of the bellows define a plurality of peaks and valleys, the valleys being positionable proximate the piston, and the peaks extending outwardly therefrom.

3. The fill valve assembly of claim 1 wherein the seal member includes a region of increased rigidity proximate at least one of the first and second ends thereof.

4. The fill valve assembly of claim 1 wherein the seal member includes a region of increased rigidity proximate each of the first and second ends thereof.

5. The fill valve assembly of claim 1 wherein the product dispensing member further comprises an upper assembly and a lower assembly.

6. The fill valve assembly of claim 1 further comprising a displacing member comprising:

an annular ring associated with the displaceable piston such that movement of the annular ring imparts movement upon the displaceable piston;

the annular ring positioned with an inner cavity of the outer housing so as to bisect the inner cavity into an upper inner cavity and a lower inner cavity; and means for displacing the annular ring within the inner cavity.

7. The fill valve assembly of claim 1 wherein the displacing means further comprises:

an upper fluid port in communication with the upper cavity; and a lower fluid port in communication with the lower cavity, wherein fluid can be selectively directed to each of the upper and lower fluid ports so as to displace the annular ring with the inner cavity.

* * * * *

UNITED STATES PATENT AND TRADEMARK OFFICE

CERTIFICATE OF CORRECTION

PATENT NO. : 6,786,248 B2
DATED : September 7, 2004
INVENTOR(S) : Johnson et al.

It is certified that error appears in the above-identified patent and that said Letters Patent is hereby corrected as shown below:

Column 7,
Line 18, delete “at a list end” and substitute -- at a first end --.

Signed and Sealed this

Fourth Day of January, 2005

JON W. DUDAS
*Director of the United States Patent and Trademark Office*